US006416332B1

(12) United States Patent
Carron et al.

(10) Patent No.: US 6,416,332 B1
(45) Date of Patent: Jul. 9, 2002

(54) DIRECT BGA SOCKET FOR HIGH SPEED USE

(75) Inventors: Ted Carron, Kanata; Richard C. Morrison, Chelsea; David C. Gattrell; Eric J. Jakola, both of Kanata, all of (CA)

(73) Assignee: Nortel Networks Limited, St. Laurent (CA)

( * ) Notice: Subject to any disclaimer, the term of this patent is extended or adjusted under 35 U.S.C. 154(b) by 0 days.

(21) Appl. No.: 09/739,896

(22) Filed: Dec. 20, 2000

(51) Int. Cl.[7] ..... H01R 12/00
(52) U.S. Cl. ..... 439/70; 439/331
(58) Field of Search ..... 439/68, 70, 71, 439/330, 331

(56) References Cited

U.S. PATENT DOCUMENTS 4,061,969 A * 12/1977 Dean
4,780,086 A * 10/1988 Jenner et al. ..... 439/42
5,534,784 A * 7/1996 Lum et al. ..... 324/757
5,587,885 A 12/1996 Swamy ..... 361/777
5,713,744 A 2/1998 Laub ..... 439/71
5,744,759 A * 4/1998 Ameen et al. ..... 174/260
6,033,235 A 3/2000 Ikeya ..... 439/71
6,075,255 A 6/2000 Liao et al. ..... 257/48

* cited by examiner

*Primary Examiner*—Khiem Nguyen

(57) ABSTRACT

The present invention relates to a socket for testing ICs and, in particular, high speed ICs in BGA packages, and a means of holding an IC package in the test socket. The socket uses resilient conductive test pads positioned on a substrate in an array to match an array of spherical contacts on the bottom of a BGA package. The BGA package is aligned with the test pads by the use of holes centered on the test pads into which the spherical contacts are seated. The test socket is provided with two flexible seals on the top of a support, which encircle the test pads. The flexible seals, together with a top surface of a support and a socket lid, define an enclosed cavity to which a vacuum is applied. The flexible seals are thereby compressed pulling the socket lid inward and forcing the IC package leads into contact with the test pads.

25 Claims, 2 Drawing Sheets

DIRECT BGA SOCKET FOR HIGH SPEED USE

FIELD OF THE INVENTION

This invention relates generally to sockets for high speed components and more particularly to sockets for testing high speed integrated circuits packaged in ball grid array packages.

BACKGROUND OF THE INVENTION

Integrated circuits (IC) are usually tested after they are packaged into IC packages to ensure that they are functional before they are assembled into final systems. There are problems inherent in devising appropriate test sockets for these packaged ICs, particularly where the ICs are packaged in ball grid array (BGA) packages and designed for high speed use.

BGA package are packages which have an array of spherical contacts on their bottom surface for connection from the IC to a substrate, typically a printed circuit board (PCB). BGA packages are normally used for ICs which require a large number of contacts. The spherical contacts are typically eutectic solder balls which are reflowed during assembly to a PCB to form a connection between the package and the PCB. Before assembly, the spherical contacts are non-compliant. Although there is typically a specification regarding the planarity of the bottom surface of the spherical contacts, some non-planarity is inherent in the manufacturing process. The combination of non-planarity and non-compliance results in difficulty in ensuring that all of the spherical contacts make the required electrical contact with test pads within a test socket during testing.

One solution which has been used to overcome the contact problem with BGA packages is to use a test socket which has spring loaded pins rather than test pads. The spring loaded pins compensate for any lack of planarity of the spherical contacts and thereby ensure that electrical contact is made with all of the spherical contacts for testing. The problem with the use of spring loaded pins for high speed applications is that the testing of the package in a socket with spring loaded pins does not adequately represent the configuration of the package during use. In particular, the spring loaded pins increase the length of the circuit path. For the testing of ICs designed for high speed applications, the increase in the length of the circuit path is unacceptable because it means that the ICs can not be properly tested at high speeds.

Another problem with the testing of BGA packages and other packages with a large number of contacts is the means by which the package contacts are brought into and maintained in electrical contact with the electrical connections of the test socket. Typically, a lid is used. The lid is pivoted around a hinge which lies along one edge of the socket. The lid is rotated into contact with the package and a lever arrangement is used to apply downward force to the lid and thereby to the package. The geometry of this arrangement means that the force applied to the package by the lid has both a vertical and a horizontal component and that force is not applied to all of the contacts at the same time but instead is applied first to those contacts closest to the hinge. The result is that the horizontal force component may cause horizontal movement or deformation of the contacts of the package such that they will not correctly align with the electrical connectors of the test socket when the lid is closed.

SUMMARY OF THE INVENTION

The present invention is directed to an improved socket for testing ICs and, in particular, high speed ICs in BGA packages. The socket uses resilient conductive test pads positioned on a substrate, or conductive test pads positioned on a resilient substrate, in an array to match an array of spherical contacts on the bottom of a BGA package. The BGA package may be aligned with the test pads by the use of holes centered on the test pads into which the spherical contacts seat themselves. The holes may also be used to interconnect conductive signal paths on layers of the substrate or to seat the package without the presence of the test pads.

The present invention also contemplates an improved means of holding an IC package in position in the test socket. In particular, the test socket is provided with two flexible seals, one outside the other, on a support surface. The flexible seals, together with the support surface and a bottom of a socket lid define an enclosed cavity. A vacuum is applied to the enclosed cavity which compresses the flexible seals and pulls the socket lid towards the test pads. The bottom surface of the socket lid is adapted to apply downward force to the IC package to force the IC package leads into contact with the test pads when the socket lid moves towards the test pads.

Advantageously, the use of resilient conductive test pads or substrate compensates for any non-planarity in the spherical contacts.

Also advantageously, the location of the test pads directly on the test substrate minimizes the additional length of signal path introduced by the test socket.

A further advantage of the present invention is that the use of the holes to align the BGA package to substrate minimizes the hardware required for the test socket.

Another advantage of the present invention is that the leads of the IC package are brought into contact with the test pads using only a vertically downward force.

A further advantage of the present invention is that the socket lid is separate from the remainder of the socket and so can be moved out of the way when an IC package is inserted into the socket.

Another advantage of the present invention is that the vacuum may be applied in a pulsing manner thereby scrubbing the leads of a non-BGA IC package or, in the case of a BGA package, helping to vibrate the leads of a BGA package into the holes.

Other aspects and features of the invention will become apparent to those ordinarily skilled in the art upon review of the following description of specific embodiments of the invention in conjunction with the accompanying figures.

BRIEF DESCRIPTION OF THE DRAWINGS

Preferred embodiments of the invention will now be described with reference to the attached drawings in which.

DETAILED DESCRIPTION OF THE EMBODIMENT

Figure 1:
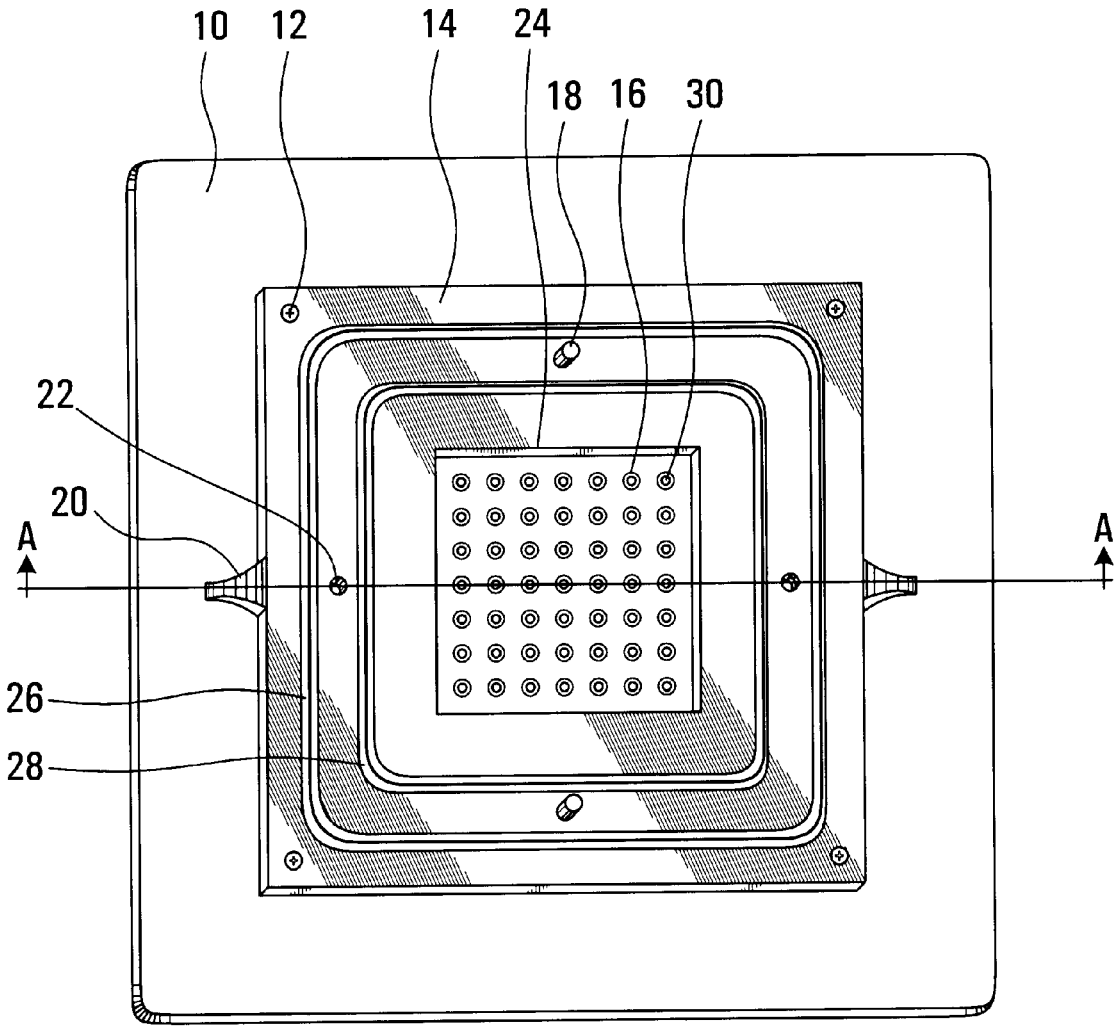
FIG. 1 is a perspective view of a test socket without a lid, for an IC packaged in a BGA package, in accordance with an embodiment of the present invention.

FIG. 1 shows a square shaped support 14 screwed to a nonconductive substrate 10 by four screws 12 at the corners of the support 14. The substrate 10 is typically a high frequency PCB (typically made of a Teflon* material) but may be any type of non-conductive substrate containing conductive tracks designed to carry electrical signals. It will normally be comprised of a substantially rigid material. The substrate 10 has a plurality of conductive electrical circuit paths (not shown) defined on a top and bottom surface and, where the substrate 10 is a multi-layer printed circuit board, the conductive electrical circuit paths also extend onto its internal layers and are interconnected to electrical circuit paths on other layers by plated holes called vias. It is preferable to route high frequency signals on the circuit paths on the surface of the substrate 10 and low frequency signals on the circuit paths on the bottom or internal layers.

Teflon is a registered trade-mark of E. L. Du Pont De Nemours and Company.

The support 14 is typically a flat piece of machined phenolic. The support 14 is depicted as square in shape but it may alternatively be cut in other shapes. It has guide pins 18 extending vertically from it for aligning a lid (not shown in this Figure) when it is placed over the support 14. The guide pins 18 are press fit into holes in the support 14 and the substrate 10. Guide pins 18 are necessary for gull wing packages where the lid 36 must be pushed down accurately on the leads. In the case of a BGA package 38, the guide pins 18 may be eliminated where the lid 36 can be manually aligned with the BGA package 38.

Attached to two opposite sides of the support 14 are vacuum connectors 20. The vacuum connectors 20 are typically conically shaped hollow ridged brass fixtures screwed into threaded holes (not shown) in the sides of the support 14. The vacuum connectors 20 are adapted to connect to and seal with a small rubber vacuum supply hose (not shown). The holes into which the vacuum connectors 20 are threaded are internally connected within the support 14 to holes 22 which extend vertically through a top support surface of the support 14.

Also attached to the support 14 are an outer vacuum seal 26 and an inner vacuum seal 28 concentrically within the outer vacuum seal 26. Both the outer vacuum seal 26 and the inner vacuum seal 28 are flexible rubber tubes with a substantially round cross-section and are formed as a continuous square. Other flexible materials, cross sectional shapes and overall shapes may be used. For example, the inner vacuum seal 28 may alternatively have a square cross-section and an overall circular shape. The outer vacuum seal 26 and the inner vacuum seal 28 are glued to the support 14 along their entire circumference so that there is an airtight seal between the inner vacuum seal 28 and the support 14 and between the outer vacuum seal 26 and the support 14. The holes 22 are located in the support 14 between the inner vacuum seal 28 and the outer vacuum seal 26 so that a vacuum may be applied through the vacuum connector 20 and the holes 22 to the cavity defined by the inner vacuum seal 28, the outer vacuum seal 26, the top support surface of support 14 and the lid (not shown in this Figure).

The support 14 has a centrally located square opening 24 defined in it. The opening 24 surrounds a plurality of conductive test pads 16 on the top surface of the substrate 10. The conductive test pads 16 are comprised of a resilient conductive material which will deform when subject to compressive force and then return to its former shape when the compressive force is removed. An example of such a material is an electrically conductive elastomer which may be screen printed onto the surface of the substrate 10 prior to assembly of the support 14 to the substrate 10 and is typically in the range of 0.25 millimeters to 0.50 millimeters in thickness. Other possible materials include polycarbonates and conductive thermoplastic compounds. Preferably, the material from which conductive test pads 16 are constructed may be removed and replaced when it is damaged avoiding the need to replace the entire substrate 10. The conductive test pads 16 depicted in FIG. 1 are circular in shape however, other geometries of conductive test pads 16, such as square shaped pads, may be used.

The conductive test pads 16 have holes 30 through their centers, preferably extending through both conductive test pads 16 and substrate 10. The holes 30 may or may not be conductively plated within the substrate 10. Between the conductive test pads 16 and the substrate 10 there are preferably non-compliant conductive ring shaped pads 44 which circling holes 30 (shown in FIGS. 2 and 3). The conductive test pads 16 overlap the ring shaped pads 44 of the holes 30 on the substrate 10 such that, where the holes to are conductively plated, the conductive test pads 16 are electrically connected to the ring shaped pads 44 and the holes 30 in the substrate 10. Preferably, ring shaped pads 44 are comprised of a metal such as copper.

The main purpose of the holes 30 is to provide a seat for alignment of the spherical contacts on the bottom face of a BGA package (not shown in this Figure) to the test pads 16. The holes 30 act as a ball detent mechanism for the spherical contacts. To facilitate the alignment between the test pads 16 and the spherical contacts on the bottom of the BGA package, and at the same time to enable electrical contact between the test pads 16 and the spherical contacts, the holes 30 must be smaller in diameter than the spherical contacts. Preferably, the holes 30 are at least ⅓ but no more than ½ the diameter of the spherical contacts. This enables the BGA package to align itself to the conductive test pads 16. Additionally, when the holes 30 are plated, the holes 30 serve as vias to connect the conductive test pads 16 to electrically conductive signal paths on other layers.

Where the BGA package has a large number of spherical contacts, it is necessary to use multiple layers of the substrate 10 to route the signal paths connected to the conductive test pads 16 out to remote test point connections on the substrate 10. In such cases, high frequency (i.e. high speed) signal paths are preferably routed on the top surface of the substrate 10 and the holes 30 connected to those signal paths are not plated. Lower frequency signal paths are routed on the bottom surface of the substrate 10 and on the internal layers of the substrate 10 and the holes 30 connecting to those signal paths are plated.

If the BGA package does not have a large number of spherical contacts, and so the signals to the conductive test pads 16 can be routed on the top layer of the substrate, then the holes 30 do not need to be plated. In fact, the holes 30 may be blind holes extending only partially through the substrate 10 or may be removed from the substrate 10 all together. If the holes 30 extend only through the conductive test pads 16, the test pads 16 must be sufficiently thick to seat the spherical contacts in the test pads 16 without bottoming out on the substrate 10. Where holes 30 are removed from the test pads 16 as well, another means of aligning the spherical contacts to the conductive test pads 16 would need to be employed. For example, the size and shape of the opening 24 could be substantially the same size as the BGA package such that the spherical contacts would be aligned with the conductive test pads 16 by the side walls of opening 24 when the BGA package was placed inside the opening 24. The material of the test pads 16 must be sufficiently resilient to compensates for any non-planarity of the spherical contacts 32 of the BGA package 34.

Figure 2:
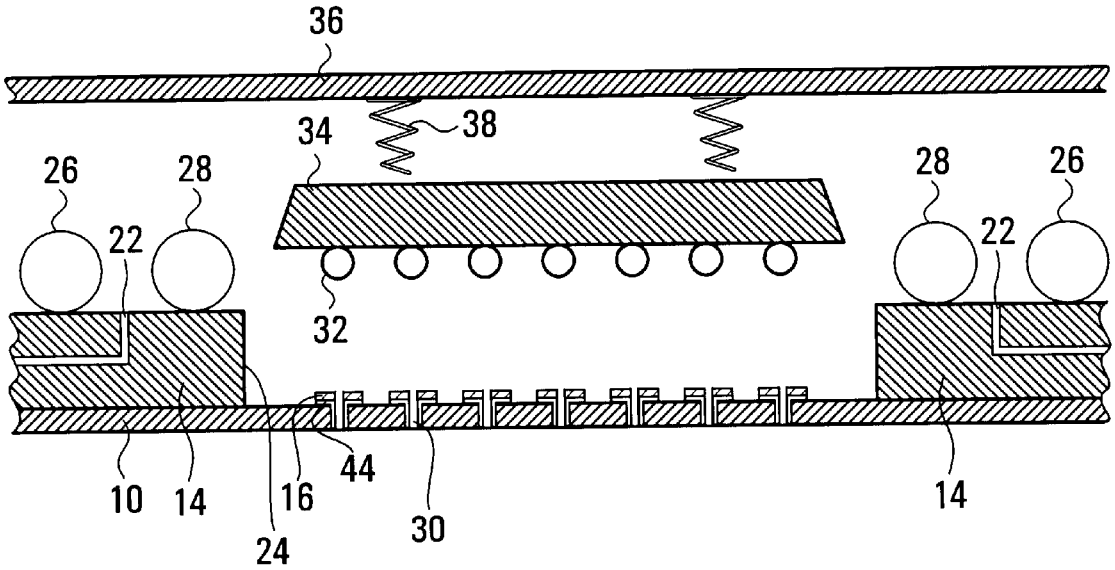
FIG. 2 is a partial exploded cross-sectional view, drawn to a larger scale, of the test socket of FIG. 1 taken along line A—A of FIG. 1 with the addition of a lid and a BGA package.

FIG. 2 depicts a BGA package 34 having a plurality of spherical contacts 32 on a bottom surface. The spherical contacts 32 are substantially co-planer although slight variations may exist as a result of the manufacturing process. The holes 30, extending through the conductive test pads 16 and the substrate 10, facilitate the alignment of the spherical contacts 32 to the conductive test pads 16. The conductive test pads 16 and the holes 30 have substantially the same configuration and pitch as the spherical contacts 32.

Assembly of the BGA package 34 to the test socket defined by the conductive test pads 16 and the holes 30 is a follows. The BGA package 34 is first placed into the opening 24 in the support 14 such that the spherical contacts 32 are seated in the holes 30 centered in the conductive test pads 16. A lid 36, having springs 38 on a bottom surface, is positioned on top of the BGA package 34 such that the springs 38 are on top of the BGA package 34. The springs 38 may be any spring loading mechanism. The lid 36 is generally comprised of a substantially flat piece of stainless steel. The lid 36 is aligned by the guide pins 18 (shown in FIG. 1) extending through the lid 36. The lid 36 may also have handles (not shown) affixed to its top surface to facilitate the lifting and the lowering of the lid 36. Where a bottom face of the lid 36 is planer with a top of the BGA package 34, the springs 38 may be eliminated. Also, if the socket is used for other package types, such as a gull wing leaded package, the lid is structured to have a protrusion to apply force to the leads and the springs 38 may be eliminated. Where the springs 38 are eliminated, the vacuum force, and the resulting compression of the inner vacuum seal 28 and the outer vacuum seal 26 controls the force applied by the lid 36 to the leads or spherical contacts, as the case may be.

The lid 36 extends to cover the cavity defined by the inner vacuum seal 28, the outer vacuum seal 26 and the top surface of the support 14. When the BGA package 34 is positioned on the conductive test pads 16 and the lid 36 is positioned in place on top of the BGA package 34, a vacuum is applied to the holes 22. It may be necessary to press slightly on the top of the lid 36 to complete the seal between the bottom surface of the lid 36, the outer vacuum seal 26, the inner vacuum seal 28 and the top surface of the support 14. Alternatively, the vacuum strength may be adjusted to ensure a seal. The resulting vacuum in the cavity pulls the lid 36 toward the conductive test pads 16 by compressing the inner vacuum seal 28 and the outer vacuum seal 26. The movement of the lid 36 towards the conductive test pads 16 causes the compression of the springs 38. The compression of the springs 38 results in a downward force being applied to the top of the BGA package 34 thereby applying a downward force to the spherical contacts 32 to bring them more securely into contact with the conductive test pads 16. In other words, the downward force of the spherical contacts 32 compresses the resilient conductive test pads 16. This compression compensates for any lack of planarity of the spherical contacts 32. The spherical contacts 32 which are not planar will cause the corresponding conductive test pads 16 to be compressed to differing degrees but will all electrically contact the appropriate conductive test pads 16.

Other means known in the art for holding the BGA package 34 into the test socket may alternatively be used. In particular, the components of the apparatus, other than the substrate 10, the conductive test pads 16 and the holes 30 may be replaced with a pivoting clamping mechanism. Equally, the lid and vacuum mechanism may be used with sockets for other types of packages, i.e. gull wing packages which require a different test pad structure than that described with respect to the conductive test pads 16 and the holes 30.

Figure 3:
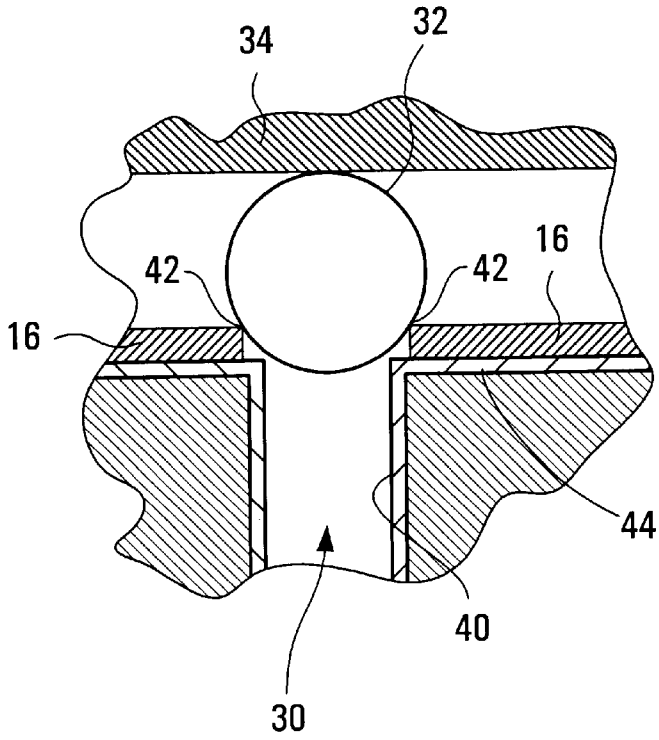
FIG. 3 is a cross-sectional view, drawn to a larger scale, of a spherical contact and a test pad in accordance with an embodiment of the present invention.

FIG. 3 depicts an enlarged view of how the spherical contacts 32 of the BGA package 34 are seated in the holes 30. The holes 30 have conductive plating 40 and the ring shaped pads 44 which extends under the conductive test pads 16. The conductive test pads 16 may extend to the edge of the holes 30 or they may be back from the edge of the holes 30 so long as they are positioned to support the spherical contacts 32. The test pads 16 form a ring of electrical contact material around each of the holes 30. When downward force is applied to the BGA package 34, the downward force is transmitted to the spherical contacts 32 and thereby to the conductive test pads 16 along a contact area 42. The result is that the non-compliant spherical contacts 32 compress the resilient conductive test pads 16 thereby ensuring good electrical contact.

The resilient conductive test pads 16 may not be present in the socket and the holes 30 used for alignment of the BGA package 34 to the substrate 10. Electrical contact can then be made between the spherical contacts 32 and the conductive signal paths on the substrate 10 by the ring shaped pads 44 of the holes 30. In this case the ring shaped pads 44 bite into the spherical contacts allowing some compensation for non-planer spherical contacts. Preferably, where the conductive test pads are 16 are not present, the substrate 10 is a comprised of a flexible material, with a flexible/compressible backing such as high density foam rubber, and a solid supporting backing. In this configuration, it is the substrate 10 itself which is resilient and deforms to compensates for any non-planarity of the spherical contacts 32.

Although the present embodiment is directed to test sockets, the socket of the present invention may also be employed in completed systems. The socket would have the same appearance and functionality if placed on a substrate forming part of a completed system. The use of the socket would allow for the easy removal and replacement of the IC if required.

The above description of embodiments should not be interpreted in any limiting manner since variations and refinements can be made without departing from the spirit of the invention. The scope of the invention is defined by the appended claims and their equivalents.

We claim:

1. A socket for an integrated circuit package having spherical contacts on its bottom surface, the socket comprising:

a nonconductive substrate;

a plurality of conductive circuit paths on the substrate;

an array of resilient electrically conductive pads on the substrate having substantially the same configuration and pitch as the spherical contacts on the package;

the array of electrically conductive pads being selectively electrically connected to the conductive circuit paths;

a means of aligning the spherical contacts with the conductive pads; and a means for bringing the spherical contacts into electrical contact with the electrically conductive pads;

wherein when the electrically conductive pads electrically contact the spherical contacts, and the resilience of the electrically conductive pads compensates for any lack of planarity in the spherical contacts.

2. The socket of claim 1 wherein the means of aligning the spherical contacts with the conductive pads is a hole extending through each of the electrically conductive pads and wherein the holes are smaller in diameter than the electrical contacts and are adapted to receive a lower portion of the spherical contacts.

3. The socket of claim 2 wherein the holes are substantially centered on the electrically conductive pads.

4. The socket of claim 2 wherein the holes extend through the substrate.

5. The socket of claim 4 wherein the holes are electrically plated.

6. The socket of claim 2 wherein a diameter of the holes is at least ⅓ and no more than ½ the diameter of the spherical contacts.

7. The socket of claim 1 wherein the means of aligning the spherical contacts with the conductive pads is a support surrounding the conductive pads defining an opening substantially the same size as the package such that when the package is positioned in the opening the spherical contacts are aligned with the conductive pads.

8. The socket of claim 5 wherein the substrate is a multi-layer printed circuit board and at least one of the holes connects to a circuit path on an internal layer of the printed circuit board.

9. The socket of claim 4 wherein a first plurality of the holes are connected to high frequency conductive circuit paths and are not plated and a second plurality of the holes are connected to low frequency conductive circuit paths and are plated.

10. The socket of claim 1 wherein the conductive pads are comprised of a conductive elastomer.

11. The socket of claim 10 wherein the elastomer is in the range of 0.25 to 0.50 millimeters thick.

12. The socket of claim 1 wherein the conductive pads are comprised of a polycarbonate.

13. The socket of claim 1 wherein the conductive pads are comprised of a thermoplastic compound.

14. The socket of claim 1 wherein the socket is a test socket for testing the functionality of the integrated circuit within the package.

15. The socket of claim 1 wherein the means for bringing the spherical contacts into electrical contact with the electrically conductive pads comprises;

a support on the nonconductive substrate defining an opening for the integrated circuit package;

a removable lid having a substantially flat bottom surface;

a first flexible seal on the support surface surrounding the opening;

a second flexible seal outside the first flexible seal on the support surface surrounding the opening;

the support surface, the bottom surface of the lid, the first flexible seal and the second flexible seal defining a cavity; and a means of applying a vacuum to the cavity;

wherein the vacuum compresses the first flexible seal and the second flexible seal thereby forcing the lid to apply a downward force to the package to bring the spherical contacts into electrical contact with the electrically conductive pads.

16. The socket of claim 15 wherein the support has at least two guide pins adapted to mate with the lid and guide it into position.

17. The socket of claim 15 further comprising a spring means attached to the bottom surface of the lid and wherein the vacuum compresses the spring means which then applies a downward force to the package.

18. The socket of claim 1 further comprising a plurality of non-compliant electrically conductive pads underlying the resilient electrically conductive pads.

19. An apparatus for retaining a plurality of contacts of an integrated circuit package in contact with a plurality of pads of a socket comprising:

a support surrounding the pads and defining a socket opening for the integrated circuit package;

a removable lid having a substantially flat bottom surface and a spring means attached to the bottom surface;

a first flexible seal on a top surface of the support surrounding the opening;

a second flexible seal outside the first flexible seal on the top surface of the support surrounding the opening;

the top surface of the support, the bottom surface of the lid, the first flexible seal and the second flexible seal defining a cavity;

a means of applying a vacuum to the cavity;

wherein the vacuum compresses the first flexible seal and the second flexible seal thereby forcing the spring means on the lid to apply a downward force to the package to bring the spherical contacts into electrical contact with the pads.

20. The apparatus of claim 19 wherein the means of applying a vacuum to the cavity comprises a hole extending through the support having a first end inside the cavity and a second end outside the cavity and a vacuum supply connected to the second end.

21. The apparatus of claim 19 wherein the top surface of the support has a least two guide pins adapted to mate with the lid and guide it into position.

22. A socket for an integrated circuit package having spherical contacts on its bottom surface, the socket comprising:

a nonconductive substrate;

a plurality of conductive circuit paths on the substrate;

a means of selectively electrically connecting the conductive circuit paths to the spherical contacts; and an array of holes on the substrate having substantially the same configuration and pitch as the spherical contacts on the package, each of the holes in the array of holes having a diameter which is at least ⅓ but no more than ½ of a diameter of the spherical contacts;

wherein the holes are adapted to seat the spherical contacts.

23. The socket of claim 22 wherein an upper edge of a plurality of the array of holes is conductively plated and the means of electrically connecting the conductive circuit paths to the spherical contacts comprises:

a support on the nonconductive substrate defining an opening for the integrated circuit package;

a removable lid;

a first flexible seal on the support surface surrounding the opening;

a second flexible seal outside the first flexible seal on the support surface surrounding the opening;

the support surface, the bottom surface of the lid, the first flexible seal and the second flexible seal defining a cavity; and a means of applying a vacuum to the cavity;

wherein the vacuum compresses the first flexible seal and the second flexible seal thereby forcing the lid to apply a downward force to the package to bring the spherical contacts into electrical contact with the conductivity plated upper edge of the plurality of the array of holes.

24. The socket of claim 22 wherein the nonconductive substrate is comprised of a flexible material with a compressible backing and a solid support.

25. The socket of claim 23 wherein the lid further comprises a spring means attached to a bottom surface wherein the spring means applies the force to the package.

* * * * *